US006527645B1

(12) United States Patent
Cline

(10) Patent No.: US 6,527,645 B1
(45) Date of Patent: Mar. 4, 2003

(54) PORTABLE PLAY TUNNEL

(76) Inventor: Denise B. Cline, 12160 Boxwood Cir., Alpharetta, GA (US) 30005

( * ) Notice: Subject to any disclaimer, the term of this patent is extended or adjusted under 35 U.S.C. 154(b) by 0 days.

(21) Appl. No.: 09/934,126

(22) Filed: Aug. 22, 2001

(51) Int. Cl.[7] ..... A63G 21/00
(52) U.S. Cl. ..... 472/116; 472/117; 482/35
(58) Field of Search ..... 472/116, 117, 472/128; 482/35, 36; 182/48, 49; 735/121, 124, 128

(56) References Cited

U.S. PATENT DOCUMENTS 1,397,009 A * 11/1921 Maynes ..... 104/138.1
2,465,187 A * 3/1949 Barrabee ..... 104/69
3,051,185 A * 8/1962 Reynolds ..... 135/115
4,122,638 A 10/1978 O'Brian et al.
5,205,748 A * 4/1993 Petersheim ..... 434/258
5,580,316 A 12/1996 Hill et al.
D381,056 S 7/1997 Wilgus
5,711,744 A * 1/1998 Strawcutter et al. ..... 482/35
5,816,980 A 10/1998 Myszka et al.
5,839,462 A * 11/1998 Randall ..... 135/128
6,062,696 A 5/2000 Bordovsky et al.
6,210,247 B1 * 4/2001 Rodriguez Ferre ..... 446/476

* cited by examiner

*Primary Examiner*—Kien T. Nguyen
(74) *Attorney, Agent, or Firm*—William B. Noll

(57) ABSTRACT

A portable, extendable and collapsible tunnel cover that is removably secured to a conventional slide, such as may be found in one's backyard. The tunnel cover includes front and rear members, and plural U-shaped rods for mounting therebetween, and a flexible cover, such as made from vinyl, extending between the front and rear members and in contact with the respective U-shaped rods. For stability in the operable and extended position, plural, rigid stabilizing arms are provided to extend between adjacent U-shaped rods, and the rods adjacent the front and rear members. When it is desired to store the tunnel cover in winter, for example, the cover may be collapsed bringing the front and rear members in close proximity to one another.

9 Claims, 2 Drawing Sheets

PORTABLE PLAY TUNNEL

FIELD OF THE INVENTION

This invention is directed to the field of a child's play enhancing device, more particularly to a portable, expandable tunnel cover for a slide, where the tunnel cover may simulate an animal or inanimate object.

BACKGROUND OF THE INVENTION

The present invention relates to a portable, accordion-like tunnel cover for use with a child's slide to enhance the child's enjoyment of a slide, such as may be found in one's backyard. Even a casual look at the backyards of many developments will show a variety of swings, slides and jungle jim type climbing apparatus. A typical outdoor swing arrangement may include a pair of swings, a platform with ladder, and a slide descending from the platform. Whether home made or purchased from a store, the swing arrangements all look alike. As a consequence, the fun in playing on the swing and slide soon fades. In recognizing that a child's interest can easily fade, the prior art developed various systems to change or modify the backyard play system for a child. Some of these prior art systems are reflected in the following U.S. Patents:

a.) U.S. Pat. No. 6,062,696, to Bordovsky et al. teaches a bubble-shaped display screen adapted to fit over a "fish-eye" portal to a modular playground compartment. The screen may either replace or augment the transparent portal window. A projection device projects video images into the display screen. The display screen and projection device may be contained within an encapsulating enclosure which readily attaches to the modular playground compartment over an existing portal, allowing retro-fitting of existing playground structures. A beam-splitter and mirrors permit the projected video image to be viewed on either of two display screens mounted on either end of the enclosure encapsulating the projection device, permitting children within the playground structure and individuals outside the playground structure to view the same image.

b.) U.S. Pat. No. 5,816,980, to Myszka et al. discloses a playground assembly that includes a playhouse structure having a plurality of walls and a tower structure having a plurality of walls. A tunnel member may be selectively attached between appropriately configured playhouse walls and appropriately configured tower walls by positioning its lug assemblies through notches formed in a selected window and rotating the tunnel member so that the notches traverse ramped surfaces and engage a stop surface. Playground assembly also includes a slide which may be selectively attached to appropriately configured playhouse and tower walls. To that end, windows in the walls are provided with lugs and the slide is provided with channels which snap over the lugs to attach the slide selectively to one of the walls.

c.) U.S. Pat. No. 5,580,316, to Hill et al. relates to a foldable play structure which includes a first wall unit, a second wall unit, and a first, axially latchable hinge. The first hinge includes a first leaf attached to the first wall unit, a second leaf attached to the second wall unit, and a first pintle extending through the first and second leaves along a first axis. The first and second leaves are slidable relative to each other along the first axis between a pivotable position, wherein the first and second leaves may pivot, relative to each other about the first axis, and a latched position, wherein pivotal movement of the first and second leaves about the first axis is restrained.

d.) U.S. Pat. No. 4,122,638, to O'Brian et al. teaches a folding structures useful for a variety of different utilitarian and play purposes. The structure can be constructed so as to utilize a Sarrus linkage modified so as to include an overcenter toggle mechanism to reinforce the linkage against inadverent or undesired folding from an expanded position. The Sarrus linkage includes two non-folding members or walls which are connected by two separate folding wall structures. Each of such wall structures includes two non-folding parts, an intermediate hinge connecting such parts, and edge hinges connecting such parts to the non-folding members or walls. At least one of the connecting wall structures is formed so as to serve as an overcenter toggle which is capable of holding the two non-folding members or walls in the expanded position while the other of the connecting wall structures serves to limit the movement of the non-folding members or walls away from one another so as to serve to apply pressure on the connecting wall structure serving as the toggle.

e.) U.S. Pat. No. D-381,056, to Wilgus illustrates an ornamental design for a lion head play tunnel that may be used indoors or outdoors.

While the foregoing references teach a variety of devices or apparatus to enhance a child's play in the backyard, none of them illustrate or otherwise teach a portable, expandable device that provides a tunnel cover for a slide, as taught by this invention. The manner by which the present invention provides the portable, expandable tunnel cover for an outdoor slide, for example, will become more apparent in the description which follows.

SUMMARY OF THE INVENTION

This invention relates to a children's play tunnel for mounting on a conventional slide, such as found in many backyards. The slide typically includes a chute with a pair of side walls, where the slide extends from a fixed elevated position to a lower position in proximity to the ground. The play tunnel is a portable and collapsible tunnel cover for the chute, where the tunnel cover comprises first and second U-shaped members for positioning respectively at the lower position and the elevated position. For support, the tunnel includes shaped rods having a pair of free ends, where the arranged between the first and second U-shaped members. The free ends thereof are in contact with the chute side walls, and a flexible cover is provided to extend between the first and second U-shaped members in contact with the plural U-shaped members. To ensure stability to the flexible cover, rigid stabilizing arms are included to extend between adjacent plural U-shaped rods. Further, cross ties extend below the chute and connect the free ends of a respective plural U-shaped member. Optional features may include an exit end that simulates an inanimate object, such as a train engine, or even animals.

Accordingly, an object of this invention is to provide a removable, flexible tunnel cover for a children's slide, such as found in a backyard.

Another object hereof is the provision of a flexible tunnel cover that may be collapsed and transported for easy storage.

A further object for the invention lies in the use of plural, rigid stabilizing arms that may be easily removed when storage is desired.

Still another object hereof is the provision of simulated objects or animals, where a former object may be a train engine, for the extended and operable tunnel cover.

Another object of the invention is to provide protection against the elements when used by children in the outdoors.

These and other objects will become more apparent from the following description, particularly when read in conjunction with the accompanying drawings.

DETAILED DESCRIPTION OF PREFERRED EMBODIMENT

Figure 1:
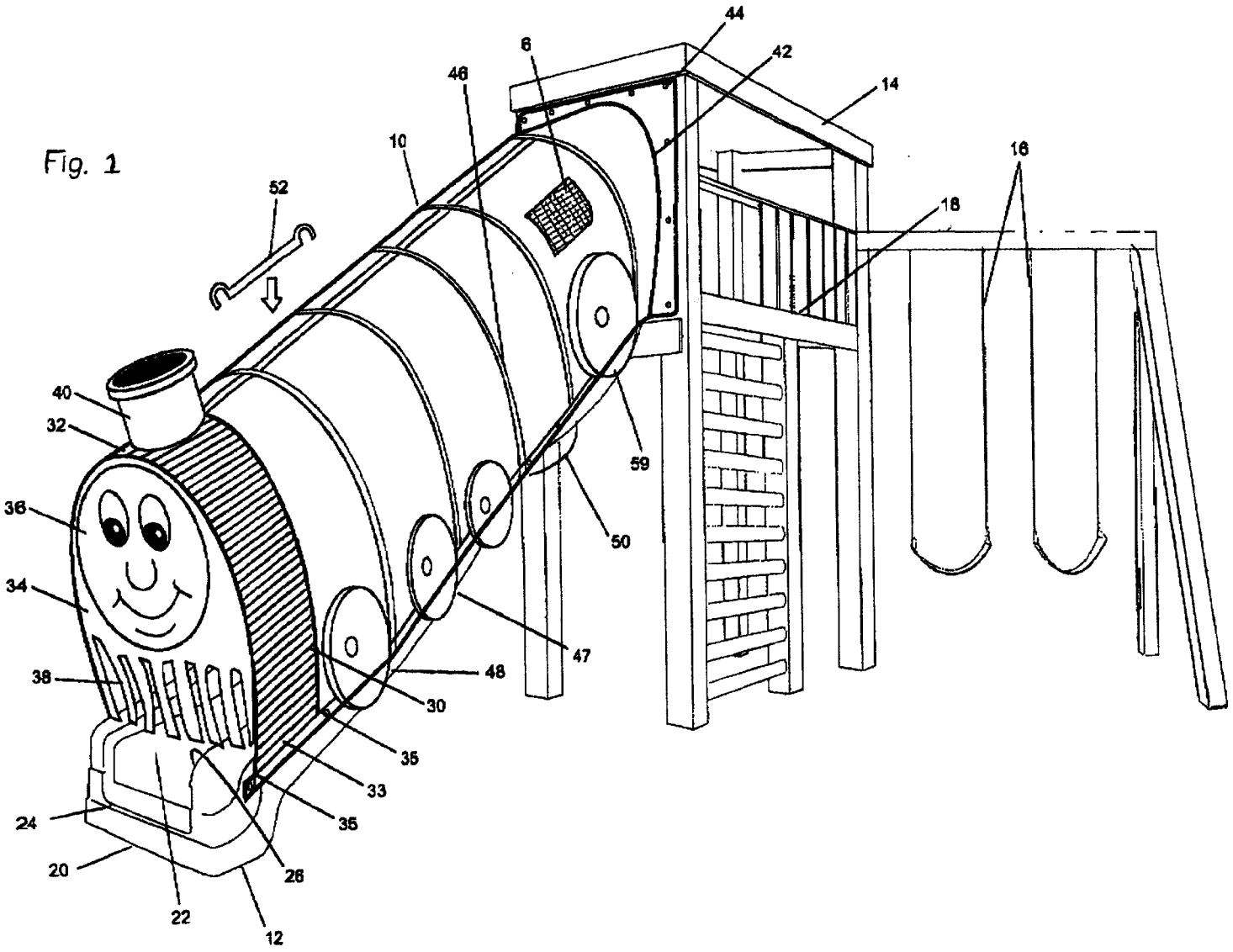
FIG. 1 is a perspective view of a typical backyard, swing and slide arrangement showing the portable and expanded tunnel cover of this invention, enclosing the slide, further showing a snap-on stabilizing bar to maintain the expanded shape of the tunnel cover, where a preferred tunnel cover simulates a train engine.

The present invention relates to a portable, expandable and collapsible, play tunnel that may simulate an animal or inanimate object, for removably mounting to a slide, such as found in backyards and playgrounds. The invention will now be described with regard to the several Figures, where like reference numerals represent like components of features throughout the various views.

Turning first to FIG. 1, the tunnel cover 10 of this invention is shown removably mounted in an operative mode on a conventional children's slide assembly 12. Though the slide assembly may vary, particularly as many are fabricated by do-it-your-self fathers for assembly in his backyard, FIG. 1 illustrates a typical slide assembly to which this invention may be mounted. By way of brief background, the slide assembly may comprise a frame 14 with a pair of swings 16 extending from one side, and a climbing platform 18. Extending from the platform is a slide 20 consisting of a chute 22, fixed to the frame 14, angled downwardly in proximity to the ground to an exit end 24. The chute 22 further includes a pair of short side walls 26 as a means to control and safely guide the children as they slide down the chute.

Figure 5:
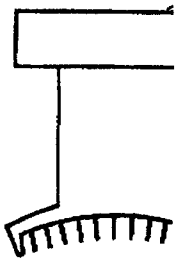
FIG. 5 is a front view of a simulated smoke stack for mounting to the train engine of FIG. 1.

The tunnel cover 10 of the present invention is intended to be mounted over the chute 22, as illustrated in FIG. 1. In this operative mode, the children slide down the chute within the tunnel cover to exit out the front end. The tunnel cover 10 comprises a front end 28, which in a preferred embodiment simulates a train engine, having a pair of rigid side walls 30 joined together by a rigid curved top portion 32. The base of the respective side walls 30 include fastening elements 33 for receiving a strap member 35, under the chute, to temporarily secure the front end 28. To continue with the train engine simulation, the front end 28 may comprise a flexible face 34 which may have a printed, simulated face 36 and plural strips 38 to allow the children to easily exit the tunnel cover. To compliment the train engine simulation, a smoke stack 40 (FIG. 5) may be mounted to the rigid curved portion 32 by hook and pile type fastening members, as known in the art, where a commercial product is sold under the trademark, VELCRO.

Figure 2:
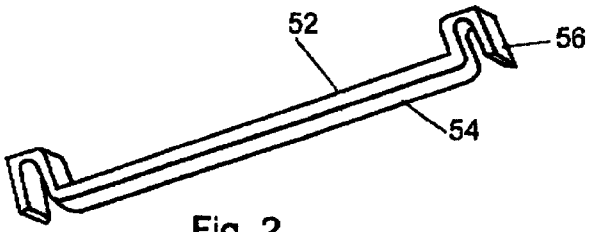
FIG. 2 is an enlarged perspective view of the snap-on stabilizing bar shown exploded in FIG. 1.

The opposite end of the tunnel cover 10 includes a rear, U-shaped member 42 that is removably attached to the frame 12, such as by plural strap elements 44 or bungee cords, as known in the art. To stabilize the tunnel cover 10 between the front end 28 and rear, U-shaped member 42, and to ensure that it is held in an open and operative mode, plural U-shaped rods 46, such as made of plastic, are spaced along the tunnel cover 10. Extending between the respective end members and intermediate U-shaped rods 46 is a flexible cover 47, such as made of vinyl, to cover the chute 22. To help maintain the position of the respective U-shaped rods, such rods include a pair of free ends 48, adjacent the side walls 26, to which straps 50 are secured by feeding under the chute 22. However, to ensure the spaced apart relationship of the plural U-shaped rods 46, a rigid stabilizing bar 52, as illustrated in FIG. 2, is provided. The stabilizing bar 52 comprises a straight body portion 54 of a discrete length, with each end featuring a reverse bend U-shaped portion 56, where the spacing of such portion 56 is of a size to snap engage a respective adjacent pair of rods 46, see FIGS. 1 and 2.

To further add to the reality of the simulated train, the flexible cover 47 may include a plurality of simulated wheels 58 and actual or simulated window 60. It is obvious that the tunnel cover may take on a variety of other simulated objects, a bus for instance, or animals, such as a dragon, though a train engine remains the preferred embodiment. Whatever the shape or depiction on the tunnel cover, it has certain added advantages to the children using the slide. For example, it keeps the chute dry, while also providing a better temperature for use, i.e. cooler in summer and warmer in winter.

Figure 4:
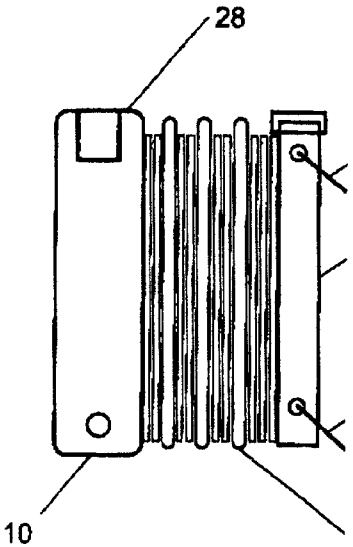
FIG. 4 is a side view of the collapsed tunnel cover of FIG. 3.
Figure 3:
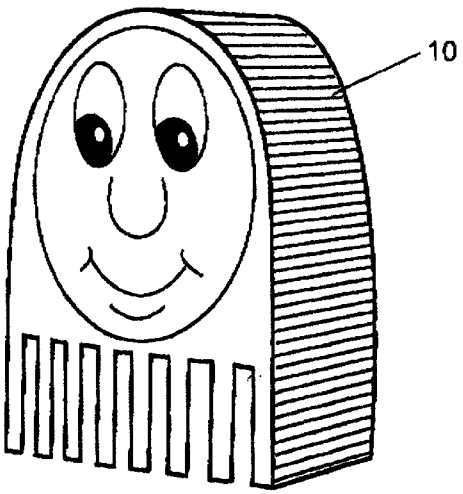
FIG. 3 is a perspective view of the collapsed tunnel cover of this invention.

A principal feature of the tunnel cover 10 of this invention is its portability. FIGS. 3 and 4 are different views of the tunnel cover in a collapsed or inoperative mode, where it may be easily handled for storage, such as may be required in winter.

It is recognized that changes, variations and modifications may be made to the structure and functionality of the tunnel cover of this invention, especially by those skilled in the art. Accordingly, no limitation is intended to be imposed thereon except as set forth in the appended claims.

What is claimed is:

1. In combination with a children's slide consisting of a chute with a pair of side walls, said slide extending from a fixed elevated position to a lower position in proximity to the ground, a portable and collapsible tunnel cover for said chute, said tunnel cover comprising first and second U-shaped members for positioning respectively at said lower position and said elevated position, plural U-shaped rods having a pair of free ends, said rods arranged between said first and second U-shaped members, where said free ends are in contact with said side walls, removable, rigid stabilizing arms extending between said plural U-shaped rods, and a flexible cover extending between said first and second U-shaped rods in contact with said plural U-shaped members.

2. The combination according to claim 1, including a cross tie extending below said chute and connecting said free ends of a respective plural U-shaped member.

3. The combination according to claim 2, wherein said first and second U-shaped members are fixed in a spaced apart relationship.

4. The combination according to claim 3, wherein said first U-shaped member comprises a pair of side walls joined together by a curved top portion, and a front face having plural, flexible strips to define an opening for said chute.

5. The combination according to claim 1, wherein said first U-shaped member simulates the head of a train engine, and said curved top portion mounts a simulated smoke stack.

6. The combination according to claim 5, wherein said simulated smoke stack is removably mounted by means of complementary hook and pile fastening members.

7. The combination according to claim 1, wherein said flexible cover is vinyl.

8. The combination according to claim 1, wherein said plural U-shaped rods are fabricated from plastic.

9. The combination according to claim 8, wherein each said rigid stabilizing arm includes a pair of ends having U-shaped slots of a size for snap engaging said plastic rods.

* * * * *